US005343024A

United States Patent [19]

Prosise et al.

[11] Patent Number: 5,343,024

[45] Date of Patent: Aug. 30, 1994

[54] MICROWAVE SUSCEPTOR INCORPORATING A COATING MATERIAL HAVING A SILICATE BINDER AND AN ACTIVE CONSTITUENT

[75] Inventors: Robert L. Prosise, Cincinnati, Ohio; Christopher W. Widenhouse, Gainesville, Fla.; Andrew J. Wnuk, Wyoming, Ohio; Paul R. Bunke; Joseph A. Milenkevich, both of Cincinnati, Ohio

[73] Assignee: The Procter & Gamble Company, Cincinnati, Ohio

[21] Appl. No.: 98,768

[22] Filed: Jul. 28, 1993

Related U.S. Application Data

[63] Continuation of Ser. No. 632,432, Dec. 21, 1990.

[51] Int. Cl.[5] ..... H05B 6/80

[52] U.S. Cl. ..... 219/730; 219/731; 219/734; 99/DIG. 14; 426/107; 426/113; 426/234; 426/243; 427/210; 428/328

[58] Field of Search ..... 219/730, 731, 10.55 E, 219/10.55 F, 10.55 M, 725, 734; 99/DIG. 14; 426/107, 113, 234, 243, 103; 427/407.1, 210, 265; 428/328, 458, 461, 34.3, 34.6; 252/510, 511; 106/74, 84

[56] References Cited

U.S. PATENT DOCUMENTS

| | | | |
|---|---|---|---|
| 3,256,101 | 6/1966 | Arns | 99/221 |
| 3,701,872 | 10/1972 | Levison | 219/10.55 |
| 3,783,220 | 1/1974 | Tanizaki | 219/10.55 |
| 3,923,697 | 12/1975 | Ellis | 252/506 |
| 3,992,212 | 11/1976 | Youtsey et al. | 106/1 |
| 3,999,040 | 12/1976 | Ellis | 219/543 |
| 4,011,088 | 3/1977 | Makishima et al. | 106/1.17 |
| 4,018,616 | 4/1977 | Sugahara et al. | 106/629 |
| 4,035,265 | 7/1977 | Saunders | 252/510 |
| 4,190,757 | 2/1980 | Turpin et al. | 219/10.55 E |
| 4,226,277 | 10/1980 | Matalon | 164/7.1 |
| 4,283,427 | 8/1981 | Winters et al. | 426/107 |

(List continued on next page.)

FOREIGN PATENT DOCUMENTS

| | | |
|---|---|---|
| 0242952 | 2/1987 | European Pat. Off. . |
| 0276654 | 8/1988 | European Pat. Off. . |
| 294983 | 12/1988 | European Pat. Off. . |
| 0345523 | 12/1989 | European Pat. Off. . |
| WO 89/04585 | 5/1989 | PCT Int'l Appl. . |
| WO 90/04516 | 10/1989 | PCT Int'l Appl. . |
| 1296855 | 11/1972 | United Kingdom . |
| 2227398 | 1/1990 | United Kingdom . |

OTHER PUBLICATIONS

Analysis of periodic arrays of rotated linear dipoles, rotated crossed dipoles, and of biplanar dipole arrays in dielectric by Thomas Wayne Kornbau, 1984.

*Primary Examiner*—Bruce A. Reynolds
*Assistant Examiner*—Tu Hoang
*Attorney, Agent, or Firm*—M. E. Hilton; Rose Ann Dabek; M. B. Graff, IV

[57] ABSTRACT

A microwave susceptor which includes a dielectric substrate and a dry layer of microwave active coating material overlaying at least a portion of the substrate is provided. The coating material includes a silicate binder and an active constituent and the weight ratio of the silicate to active is about 98:2 or less (i.e. less silicate). The dry layer is electrically continuous and has a surface concentration of active constituent of about I gram per square meter or greater. Sodium silicate is preferred as the binder and graphite is preferred as the active constituent. In addition additives such as saccharides, glycerine and plasticizers can be added to inhibit thermal shut down and to increase the flexibility of the dry layer. The susceptor can exhibit moderate heat performance or even high heating performance if desired. A susceptor baking cup, a baking system including a dome shaped cover which can be used to form an enclosure, and a container for frying are all possible uses for this microwave active coating material.

28 Claims, 9 Drawing Sheets

U.S. PATENT DOCUMENTS 4,434,197 2/1984 Petriello et al. ..... 427/407.1
4,518,651 5/1985 Wolfe, Jr. ..... 428/308.8
4,542,271 9/1985 Tanonis et al. ..... 219/10.55 E
4,626,641 12/1986 Brown ..... 219/10.55 E
4,640,838 2/1987 Isakson et al. ..... 426/107
4,655,276 4/1987 Bird et al. ..... 164/519
4,696,764 9/1987 Yamazaki ..... 252/503
4,751,358 6/1988 Durand ..... 219/10.55 E
4,760,310 7/1988 Deyama et al. ..... 313/479
4,800,247 1/1989 Schneider et al. ..... 219/10.55 E
4,806,718 2/1989 Seaborne et al. ..... 219/10.55 E
4,808,780 2/1989 Seaborne ..... 219/10.55 E
4,810,845 3/1989 Seaborne ..... 219/10.55 E
4,814,568 3/1989 Keefer ..... 219/10.55 E
4,818,831 4/1989 Seaborne ..... 219/10.55 E
4,825,024 4/1989 Seaborne ..... 219/10.55 E
4,826,631 5/1989 Sullivan ..... 252/512
4,833,007 5/1989 Huang ..... 428/242
4,859,822 8/1989 Ragusa et al. ..... 219/10.55 E
4,864,089 9/1989 Tighe et al. ..... 219/10.55 E
4,866,232 9/1989 Stone ..... 219/10.55 E
4,876,423 10/1989 Tighe et al. ..... 219/10.55 E
4,876,427 10/1989 Mode ..... 219/10.55 E
4,878,765 11/1989 Watkins et al. ..... 383/116
4,880,951 11/1989 Levinson ..... 219/10.55 E
4,904,836 2/1990 Turpin et al. ..... 219/10.55 E
4,917,748 4/1990 Harrison ..... 156/230
4,923,704 5/1990 Levinson ..... 426/243
4,927,991 5/1990 Wendt et al. ..... 219/10.55 E
4,943,456 7/1990 Pollart et al. ..... 428/34.3
4,950,857 8/1990 Seaborne ..... 219/10.55 E
4,956,533 9/1990 Seaborne ..... 219/10.55 E
4,959,516 9/1990 Tighe et al. ..... 219/10.55 F
4,962,000 10/1990 Emslander et al. ..... 428/461
4,962,293 10/1990 Lackey ..... 219/10.55 E
4,965,423 10/1990 Seaborne ..... 219/10.55 E
4,965,427 10/1990 Seaborne ..... 219/10.55 E
4,968,865 11/1990 Seaborne et al. ..... 219/10.55 E
4,969,968 11/1990 Leatherman ..... 156/272.4
4,970,358 11/1990 Brandberg et al. ..... 219/10.55 E
4,972,058 11/1990 Benson et al. ..... 219/10.55 E
4,973,502 11/1990 Holzmuller et al. ..... 428/35.8
4,977,302 12/1990 Meriguad et al. ..... 219/10.55 E
4,993,212 6/1990 Gerstner et al. ..... 427/258
5,006,405 4/1991 Watkins et al. ..... 428/323
5,021,293 6/1991 Huang et al. ..... 428/328
5,106,635 4/1992 McCutchan et al. ..... 426/107
5,132,144 7/1992 Parks ..... 427/210
5,175,031 12/1992 Ochocki ..... 428/34.2

MICROWAVE SUSCEPTOR INCORPORATING A COATING MATERIAL HAVING A SILICATE BINDER AND AN ACTIVE CONSTITUENT

This is a continuation of application Ser. No. 07/632,432, filed on Dec. 21, 1990.

BACKGROUND OF THE INVENTION

1. Field of the Invention

The present invention relates to microwave field modifiers, and more particularly, to such modifiers which generate a significant amount of heat, i.e., susceptors. Specifically, the present invention relates to susceptors consisting of an electrically continuous coating material coated on a dielectric substrate.

2. Description of the Prior Art

Microwave ovens possess the ability to heat, cook or bake items, particularly foodstuffs, extremely rapidly. Unfortunately, microwave heating also has its disadvantages. For example, microwave heating alone often fails to achieve such desirable results as evenness, uniformity, browning, crispening, and reproducibility. Contemporary approaches to achieving these and other desirable results with microwave ovens include the use of microwave field modifying devices such as microwave susceptors.

Generically, microwave susceptors are devices which, when disposed in a microwave energy field such as exists in a microwave oven, respond by generating a significant amount of heat. The susceptor absorbs a portion of the microwave energy and converts it directly to thermal energy which is useful for example to crispen or brown foodstuffs. This heat may result from microwave induced intramolecular or intermolecular action; from induced electrical currents which result in so called $I^2R$ losses in electrically conductive devices (hereinafter referred to as ohmic heating); or from dielectric heating of dielectric material disposed between electrically conductive particles, elements or areas (hereinafter alternatively referred to as fringe field heating or capacitive heating).

In any event the microwave susceptor absorbs a portion of the microwave energy within the oven cavity. This absorption reduces the amount of microwave energy available to cook the food. Simultaneously, the susceptor makes thermal energy available for surface cooking of the food by conductive or radiant heat transfer. Thus, susceptors tend to slow down direct microwave induction heating to provide some thermal heating which tends to be more uniform and provide such desirable results as browning or crispening.

Currently, the most commercially successful microwave susceptor is a thin film susceptor which heats through the $I^2R$ mechanism resulting in ohmic heating. Typically, thin film susceptors are formed of a thin film of metalized aluminum vacuum deposited on a polyester layer which is adhered to paper or cardboard. This type of susceptor has its limitations. For example, these thin film susceptors provide only moderate heating performance. They do not generate the high heating performance necessary to brown or crispen high moisture content foods. More importantly, thin film susceptors are expensive to manufacture and lack the versatility and manufacturing cost advantages that coating materials offer.

Various other microwave susceptors have been proposed but have not been as commercially successful. A large number of these susceptors employ graphite or carbon as the microwave active particle. Although some of these susceptors can reach high temperatures, they tend to suffer from either runaway heating or significant degradation. Runaway heating occurs when such high power is generated over the heating cycle that the temperature rises above desirable limits. Significant degradation occurs when the susceptor degrades during the cooking cycle reducing heat output such that all conduction cooking virtually ceases. Examples of such suceptors are disclosed in U.S. Pat. No. 4,640,838 issued to Isakson et al., on Feb. 3, 1987, U.S. Pat. No. 4,518,651 issued May 21, 1985 to Wolfe, Jr., and U.S. Pat. No. 4,959,516 issued to Tighe et al., on Sep. 25, 1990.

As another example, U.S. Pat. No. 4,190,757 issued to Turpin et al. on Feb. 26, 1980 discloses a microwave package. The package includes a susceptor made up of a preferably metal substrate and a relatively thick dry layer. The dry layer is made up of a binder containing a lossy material. Sodium silicate is mentioned as a binder and such things as semiconductors, ferromagnetic materials, carbon or graphite are suggested as the lossy material.

It is believed that the present invention offers a unique combination of benefits. The susceptor of the present invention is capable of reaching extremely high temperatures. This enables it to cook foods which heretofore did not favorably brown and crispen in the microwave oven. Moreover, the susceptor can be formulated such that when a maximum temperature is reached the susceptor shuts down which avoids runaway heating. This can be important for example, if inexpensive but ignitable substrates such as paper are desired; particularly if a temperature near the ignition point is desired for effective cooking. Furthermore, although these high temperatures can be reached, the mass of the susceptor can be small to allow quick cooling avoiding possible injury.

SUMMARY OF THE INVENTION

In accordance with one aspect of the present invention a microwave susceptor is provided which includes a microwave active coating material and a dielectric substrate. The microwave active coating material includes a silicate binder and an active constitute. The weight ratio of the silicate to active in the coating material is about 98:2 or less (i.e., less silicate). The dielectric substrate has a dry layer of the microwave active coating material overlaying at least a portion of the substrate. The dry layer is electrically continuous and has a surface concentration of the active constituent of about 1.0 gram per square meter or greater. The silicate is preferably a sodium silicate and the active constituent is preferably graphite.

In accordance with another aspect of the present invention a microwave susceptor is provided which exhibits moderate heating performance. This susceptor includes a microwave active coating material including a silicate binder and an active ingredient. The weight ratio of the silicate to active in the coating material is from about 90:10 to about 80:20. The susceptor also includes a dielectric substrate which has a dry layer of the microwave active coating material overlaying at least a portion of the substrate for generating moderate heating performance. The dry layer is electrically continuous and has a surface concentration of the active constituent of about 1.0 gram per square meter or greater.

In accordance with another aspect of the present invention a microwave susceptor is provided which exhibits high heating performance. This susceptor includes a microwave active coating material including a silicate binder and an active ingredient. The weight ratio of the silicate to active in the coating material is from about 80:20 to about 40:60. The susceptor also includes a dielectric substrate which has a dry layer of the microwave active coating material overlaying at least a portion of the substrate for generating high heating performance. The dry layer is electrically continuous and has a surface concentration of the active constituent of about 1.0 gram per square meter or greater.

In accordance with another aspect of the present invention a single serve baking system is provided. This baking system includes a domed top including a dome shaped substrate capable of withstanding relatively high baking temperatures. A dry layer of microwave active coating material having a $\Delta T_{120}$ above about 200° F. overlaying at least a portion of the dome shaped substrate. The domed top is adapted for placement over the item to be baked. The domed top preferably cooperates with a base element to form an outer enclosure. The baking system preferably further includes a susceptor located in the area of the base element.

In another aspect of the present invention a susceptor baking cup is provided. The baking cup includes a relatively flexible microwave transparent dielectric substrate and a relatively dry layer of brittle coating material overlaying at least a portion of the substrate. Furthermore, a protective layer capable of retaining any dislodged flakes of the dry layer is disposed over the dry layer sandwiching the dry layer between itself and the substrate. The flexible layer is preferably a layer of an alkaline-stable polymer latex plasticizer or paper.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify similar elements and wherein;

DESCRIPTION OF THE PREFERRED EMBODIMENT

Figure 1:
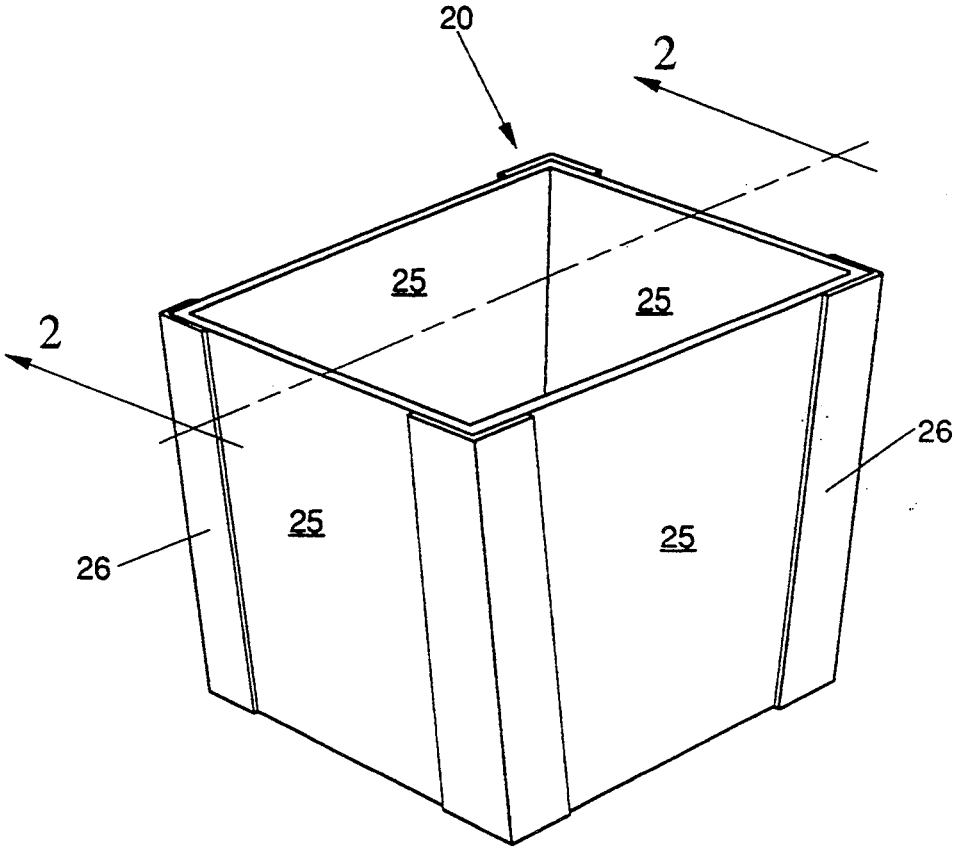
FIG. 1 is a perspective view of a preferred embodiment of a susceptor of the present invention formed into a baking cup.
Figure 2:
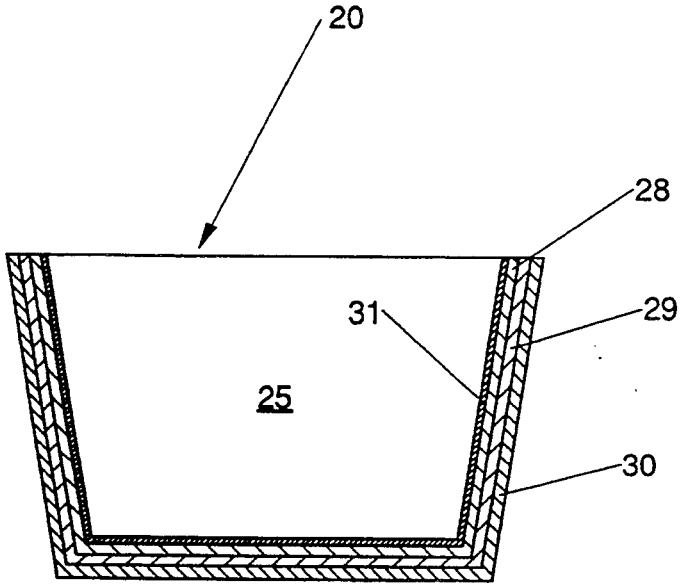
FIG. 2 is an enlarged cross sectional view taken along line 2—2 of FIG. 1.

A preferred susceptor of the present invention formed into a baking cup 20 is illustrated in FIG. 1 and FIG. 2 and basically includes a dielectric substrate 30 and a dry layer 29 of a microwave active coating material overlaying at least a portion of the substrate 30. The overlaying dry layer 29 is generally coated directly on the substrate 30; however, an additional layer of material may be disposed therebetween. This embodiment also includes a protective layer 28 covering the dry layer 29 and a release coating 31. The coating material includes a silicate binder or matrix and a microwave active constituent. The susceptor is generally formed by coating the coating material onto the substrate 30 while in its wet state and allowing it to dry. "Dry" as used herein means having a sufficiently low moisture content such that the composition is in a relatively stable state. In the case of coating materials of this invention this dry state generally occurs below about 25% moisture content. The dry layer 29 of a susceptor of the present invention must be electrically continuous.

Figure 3:
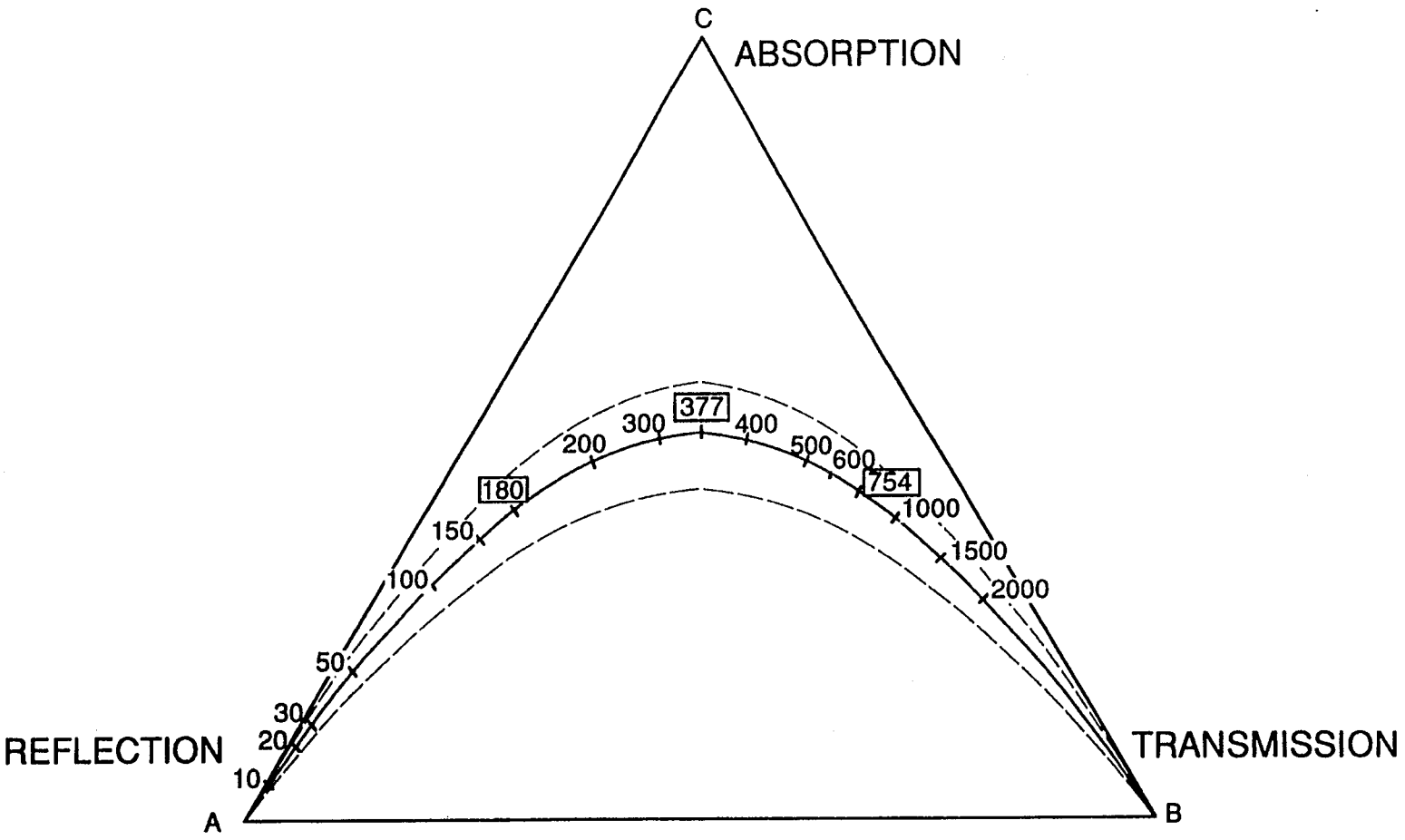
FIG. 3 is a three component diagram illustrating the relationship between absorption, reflection, transmission and approximate resistivity for an electrically continuous layer.

Whether the dry layer is electrically continuous can be determined by measuring the reflectance, absorbance and transmittance; i.e., RAT values. If the dry layer is electrically continuous it will have RAT and surface resistance values which correspond to a specific relationship. This relationship is shown in FIG. 3 as a plot on a three component diagram. To determine if a dry layer is electrically continuous, simply perform an RAT test and compare the results to FIG. 3. If the results fall on the curve or plus or minus about fifteen percent thereof (based upon absorption as seen in FIG. 3) due to variability of the measurements then the layer is electrically continuous. This method is problematic in cases of extremely high resistivities (i.e. above about 10,000 grams per square) due to the inability to accurately measure in this range. However, samples of extremely high resistivity tend to heat less effectively.

One method of measuring RAT values uses the following Hewlett Packard equipment: a Model 8616A Signal generator; a Model 8743A Reflection-Transmission Test Unit; a Model 8411A Harmonic Frequency Converter; a Model HP-8410B Network Analyzer; a Model 8418A Auxiliary Display Holder; a Model 8414A Polar Display Unit; a Model 8413A Phase Gain Indicator; a Model S920 Low Power Wave Guide Termination; and two S281A Coaxial Waveguide Adapters. In addition a digital millivolt meter is used.

Connect the RF calibrated power output of the 8616A Signal Generator to the RF input of the 8743A Reflection-Transmission Test Unit. The 8411A Harmonic Frequency Converter plugs into the 8743A Reflection-Transmission Test Unit's cabinet and the 8410B Network Analyzer. Connect the test channel out, reference channel out, and test phase outputs of the 8410B Network Analyzer the test amplitude, reference and test phase inputs, respectively, of the 8418A Auxiliary Display Holder. The 8418A Auxiliary Display Holder has a cabinet connection to the 8414A Polar Display Unit. The 8413A Phase Gain Indicator has a cabinet connection to the 8410B Network Analyzer. The amplitude output and phase output of the 8413 Phase Gain Indicator is connected to the digital millivolt meter's inputs.

The settings of the 8616A Signal Generator are as follows: Frequency is set at 2,450 GHz; the RF switch is on; the ALC switch is on to stabilize the signal; Zero the DBM meter using the ALC calibration output knob; and set the attenuation for an operating range of 11 db. Set the frequency range of the 8410B Network Analyzer to 2.5 which should put the reference channel level meter in the "operate" range. Set the amplitude gain knob and amplitude vernier knob as appropriate to zero the voltage meter readings for reflection and transmission measurements respectively.

Circular susceptor samples are cut to three and one-half inches in diameter for this test procedure.

For Reflection place the 8743A Reflection-Transmission Unit in the reflection mode. A S281 Coaxial Waveguide Adaptor is connected to the "Unknown" port of the 8743A Reflection-Transmission Test Unit. A perfect shield (aluminum foil) is placed flat between the reflection side of the S281 wave guide adaptor and the S290A Low Power Guide Termination. The amplitude voltage is set to zero using the amplitude gain and vernier knobs of the 8410B Network Analyzer. The shield is replaced by the sample of the susceptor. In other words, the sample is placed between the S281A Coaxial Waveguide Adaptor and the S920A Low Power Waveguide Termination and the attenuation voltage is measured. Normally, four readings are taken per sample and averaged. The samples are rotated clockwise ninety degrees per measurement. After the second measurement the sample is turned over (top to bottom) for the final two measurements. For polarized, isotropic samples care must be taken to orient the samples such that the maximum and minimum readings in millivolts (mv) are obtained. The % R value is calculated from the maximum reading using the equation $$\% R = \frac{100}{\text{Log}^{-1}[2\ (\text{mv})]}$$

These samples may also be rotated in increments other than 90°.

For Transmission place the 8743A Reflection-Transmission Unit in the transmission mode. A 10 db attenuator is placed in the transmission side of the line, between the "In" port of the 8743 Reflection-Transmission Unit and a second S281A Coaxial-Waveguide Adaptor. The two S281A Coaxial-Waveguide Adaptors are aligned and held together securely. The amplitude signal voltage is zeroed using the amplitude gain and vernier knobs of the 8410B Network Analyzer. The susceptor to be tested is placed between the two waveguide adaptors and the attenuation voltage is measured. Four readings in millivolts (mv) are taken as described above for the reflection measurement. Reflection and transmission values should be calculated in the same manner; i.e. average or maximum and using the equation $$\% T = \frac{100}{\text{Log}^{-1}[2\ (\text{mv})]}$$

Percent absorption is calculated by subtracting the percent transmission measurement and the percent reflection measurement from 1.00.

Once the values for absorption, transmission and reflection have been obtained, simply plot the results on one of the relationship curve of FIG. 3. If the results fall on the curve or within about fifteen percent thereof due to variability of the measurements, then the layer is electrically continuous. If the results do not fall within this range of the curve then the layer is not electrically continuous and is not within the scope of this invention. Some susceptors of this invention change in resistivity during exposure to a microwave energy field. Thus, for these susceptors the values for absorption, reflection, transmission and resistance also change during use. As they change they remain electrically continuous, i.e., stay on the curve, but move in the direction of increasing resistivity. It should be noted that some very conductive susceptors may actually become more effective heaters as their resistance increases into the maximum power generation range, i.e. toward A=50%. Other susceptors may decrease in heating as their resistance increases beyond the maximum power generation range.

It should be noted that RAT values as measured in the network analyzer may be different from actual RAT values when a microwave susceptor is placed in competition with a food load. Furthermore, the above method assumes that the RAT values are not altered as a result of the substrate. However, certain substrates such as glass can interfere with the accuracy of these RAT measurements. Thus, it is best to perform these RAT tests with the dry layer on a substrate made of cellulosic material such as a clay coated paper.

As previously mentioned the microwave active coating material includes a silicate binder and an active constituent. Silicate binders are generally referred to in terms of $\% SiO_2/\% M_2O$ where M may be an alkali metal such as lithium, potassium or sodium. Sodium silicate is the preferred silicate binder. Sodium silicate is commercially available in various weight ratios of $SiO_2$:$Na_2O$ from about 1.6:1 to about 3.75:1 in water solution. The most preferred sodium silicate has a weight ratio of 3.22:1. A 3.22 sodium silicate can be purchased from Power Silicates Inc., Claymont, Del. as an "F" Grade Solution with about 37% solids. The lower ratios are more alkaline and absorb water more readily making them less desirable. In addition, they are stickier when dry. The higher ratios while feasible, do not seem to be as readily available commercially.

The active constituent can be particles of carbon, graphite, metals, semiconductors or a combination thereof; preferably carbon or graphite; more preferably graphite; and most preferably synthetic graphite. Graphite generates significant heat flux and has less of an arcing problem than the higher conductive actives such as metals. Synthetic graphite does not have some of the natural impurities found in natural graphite. Natural graphite can be obtained from J. T. Baker Inc., Phillipsburg, N.J. as Graphite (96%) (325 Mesh). Synthetic graphite can be obtained from Superior Graphite Co., Chicago, Ill. as Synthetic Purified Graphite, No. 5535 and No. 5539. Suitable conductive (i.e. $10^{-6}$ to $10^{-4}$ OHM—CM) metals include aluminum, copper, iron, nickel, zinc, magnesium, gold, silver, tin and stainless steel. Suitable semiconductor materials (i.e. $10^{-4}$ to 1 OHM—CM) include silicon carbide, silicon, ferrites and metal oxides such as tin oxide and ferrous oxide. It should be noted that some metals (such as aluminum) and some semiconductors (such as silicon) will react with the sodium silicate and care must be taken to ensure performance. Also, many of the so-called magnetic materials include a resistive component which facilitates their heating in a microwave field. Magnetic heating is not an object of this invention as it typically requires relatively thick coatings and metal substrates for optimal performance, although some magnetic heating may occur in some coating materials of this invention.

The active particles preferably have a maximum dimension and shape which allows for coating the coating material in the preferred thickness range. The active particles more preferably have a maximum dimension below about 100 microns. Even more preferred is a particle size of less than 50 microns for ease of coating and uniformity. Particle geometry should be such that contact between particles is facilitated. Virtually any particle shape can work if the particles are included in the right quantity. However, certain shapes are preferred because they seem to facilitate contact between particles. For example, particles with a significant aspect ratio, i.e., above 10:1 are preferred. Other particle characteristics may be important with respect to thermal shut down. For example, activated charcoal seems to interlock reducing the tendency to shut down. In contrast, printing grade carbon which is relatively smooth tends to readily permit shut down. Shut down will be discussed more fully hereinafter.

The silicate binder and the active are preferably mixed together such that the weight ratio of the silicate binder solids to the active constituent in the coating material is preferably about 98:2 or less (i.e. less silicate). Although the silicate binder is generally purchased in solution form, this weight ratio is based on the dry silicate weight, i.e., the weight of the silicate solids to the active constituent solids.

More preferred ranges depend upon the type of performance desired from the susceptor. For example, a particular application may require high heating performance while another application may require only moderate heating performance. Heating performance can be characterized in terms of an Energy Competition Test discussed below. This Test has been developed to determine the heating characteristics of susceptors (at least relative to other susceptors) when they are in competition with a load. The results of this Test are measured in terms of the change in temperature over 120 seconds resulting from the susceptor (hereinafter $\Delta T_{120}$). To conduct the Energy Competition Test, place a 150 ml pyrex beaker containing 100 grams of distilled water in a carousel microwave oven having a 30 BTU/minute power rating as measured with a 1000 gram water load. Also place on the carousel a three and three quarter inch diameter pyrex petri dish containing 30 grams of Crisco® Oil. These items are placed side by side about nine inches on center apart in competition with each other. Take an initial temperature reading of the oil. Subject these items to the full power of the microwave field for a total of 120 seconds; at 30 second intervals open the microwave oven and stir the oil with a thermocouple, measuring and recording the temperature. This measurement should be taken as quickly as possible to minimize cooling of the oil. This procedure provides a control.

Repeat the above procedure with a three and one half inch diameter sample of a microwave susceptor submerged in the oil. Begin with the oil at about the same initial temperature as with the control (i.e., about 70° F.). It may be necessary to place an inert weight, such as a glass rod, on top of the susceptor to keep it submerged in the oil. The data can be normalized by adjusting the initial temperature to a standard 70° F. by subtracting or adding the initial temperature deviation from 70° F. to each of the temperatures recorded.

Once the test has been run, one method which can be used for comparison of the power of various microwave susceptors is to compare the change in temperature over the two minute time interim. Thus, the 120 second $\Delta T$ for a given susceptor (hereafter $\Delta T_{120}$) is calculated by subtracting the 120 second $\Delta T$ of the oil alone from the 120 second $\Delta T$ of the oil and susceptor. Additionally, the two minute $\Delta T$ of the susceptor is normalized by adding or subtracting any initial temperature variance of the oil from 70° F.

As with measuring RAT through the use of a network analyzer, the Energy Competition Test may not predict exactly how well a susceptor will heat in the microwave in conjunction with a particular food load. The greater the variance in microwave properties of the actual food load from the properties of the water load, the less accurate this test may be for predicting actual performance in a particular application. However, the use of water is intended to simulate the susceptor in competition with a load and provides a valid comparative measurement tool.

As used herein a susceptor exhibiting moderate heating performance generates a $\Delta T_{120}$ of from about 75° F. to about 200° F. In contrast, a susceptor exhibiting high heating performance generates a $\Delta T_{120}$ above about 200° F. A 200° F. $\Delta T_{120}$ corresponds to slightly greater than the $\Delta T_{120}$ of thin film susceptors. Moreover, a susceptor exhibiting a $\Delta T_{120}$ above about 200° F. will tend to char or burn a paper substrate in a no load situation, i.e., in a microwave oven (e.g. having a 35 BTU/-minute power rating as measured with a 1000 gram water load) with no other load present.

For a heat generating microwave susceptor made using graphite, carbon or other actives having a bulk surface concentration of from about 1.7 g/cm$^3$ to about 2.5 g/cm$^3$ the binder:active weight ratio is more preferably from about 98:2 to about 40:60. The binder:active weight ratio for moderate heating performance is most preferably from about 90:10 to about 80:20. The binder:active weight ratio for high heating performance is most preferably from about 80:20 to about 40:60. For metals and other actives having a surface concentration of about 8.5 g/cm$^3$ or greater the binder:active weight ratio is more preferably from about 96:4 to about 5:90. The binder:active weight ratio for moderate heating performance is most preferably from about 80:20 to about 60:40. The binder:active weight ratio for high heating performance is most preferably from about 60:40 to about 10:90.

The dielectric substrate must be a nonmetal for this invention. For moderate heating performance susceptors the substrate is more preferably made from a cellulosic material and the cellulosic material may be treated with silicate or other flame retardant material to prevent ignition when subjected to the heat generated by the dry layer. In addition, the cellulosic material may be coated with a coating to reduce its porosity. Clay coated papers are preferred. In any event, the cellulosic material will preferably exhibit minimal charting when subjected to the heat generated by the dry layer. Charring makes more carbonized material available which can drastically accelerate heating; creating run away heating. For high heating performance susceptors ceramic substrates such as glass are preferred. Certain polymers may also be capable of withstanding the high temperatures.

Once mixed, the microwave active coating material can be coated onto the substrate in any desired manner. For example, printing, painting, spraying, brushing, Mayer rods and even laminating using a nip could all be acceptable ways of coating the coating material onto a substrate. The dry layer should be laid down, however, such that there is a sufficient surface concentration of the active constituent to enable the desired heating.

The dry layer preferably has a surface concentration of the active constituent of about 1.0 gram per square meter or greater for graphite. More preferably, the surface concentration of the active constituent is from about 1.0 gram per square meter to about 100 grams per square meter; and most preferably from about 2.0 grams per square meter to about 30 grams per square meter. For poorer conductors (i.e., $>10^{-3}$ OHM—CM) and for more dense materials (i.e., $>2.5$ g/cm$^3$) the preferred range is generally above 100 g/m$^2$. Recognize that higher temperatures generally result when the surface concentration of the active constituent for a given coating material is increased. The surface concentration of the active constituent can be determined by subtracting the initial substrate weight from the combined substrate and coating weight. Also, determine the water content of the dry layer. Knowing the water content, the weight of the coating material, the weight ratios between the silicate solids and the active and any other additive, the weight of the active in the dry layer can be determined. This weight is then divided by the total coated area to give the dimensional units, grams per meter squared.

The thickness of the dry layer is governed somewhat by the active constituent surface concentration in the dry layer. This is not completely true because different substrates will hold different amounts of the dry layer within their boundaries resulting in different gross measurements. For example, if the dry layer is laminated between two porous substrates, such as paper, the same amount of material would have a smaller gross measurement than if it were directly coated onto a single nonporous substrate due to absorption into the substrate. In fact, performance may suffer if too much coating material is absorbed. To reduce the amount of the coating material absorbed into the substrate, a coated paper may be used. For example, clay coated paper has been found helpful. Generally speaking the measured thickness of the dry layer is preferably less than about 0.020 inches 0.05 cm. Thicker layers will work but will become more expensive and cumbersome with no real added benefit. More preferably, the thickness of the dry layer is from about 0.0001 inches 0.0025 cm. to about 0.010 inches 0.025 m, and most preferably from about 0.0005 inches 0.0125 cm to about 0.006 inches 0.015 cm.

The dry layer preferably has an initial resistivity from about 2 ohms per square to about 20,000 ohms per square; more preferably from about 10 ohms per square to about 5,000 ohms per square. One method of measuring surface resistivity utilizes a conductivity probe such as an LEI Model 1300MU Contactless Conductivity Probe which may be purchased from Lehighton Electronics, Inc., Lehighton, Pa. Prior to taking a measurement the instrument is zeroed. To take a measurement the sample is placed under the measurement transducer. The resistivity is then read from the digital display in MHOS per square and inverted to give ohms per square. It should be understood that measuring the resistivity alone by this method cannot distinguish between an electrically continuous layer and a capacitive layer.

The microwave active coating material can be dried in many ways. For example, the coating can be ambient dried, i.e., left to dry at room temperature, or the coating can be oven dried to a target moisture content. The coating should be dried to a point at which the coating material is relatively stable. The moisture content of the dry layer is preferably about 25% or less, more preferably from about 5% to about 20% and most preferably from about 15% to about 20%.

As noted earlier, the absorption, reflection, transmission and resistivity of the dry layer of many of these susceptors change upon exposure to microwave energy field. Although not wishing to be bound by this theory, it appears one reason for this change in characteristics is due to volumetric expansion of the silicate. Upon heating the water in the silicate vaporizes and forms bubbles. Above about 200° F. the silicate matrix softens allowing the escaping water vapor to initiate foaming of the silicate causing it to expand. As the silicate expands the electrical quality of the contact between the individual active particles decreases. Consequently, the resistance of the dry coating increases. Depending upon where the modifier started on the RAT three component diagram of FIG. 3, heating will either increase or decrease due to this change. Generally, as resistance increases, heating decreases and the susceptor begins to shut down; i.e., the amount of heat it produces decreases.

Another phenomenon which may cause the susceptor to shut down has to do with the relative rates of thermal expansion between the substrate and the dry layer. If the substrate expands significantly more rapidly than the dry layer upon heating, discontinuities or partial cracks may result in increased resistivity of the dry layer. Based on R-A-T analysis and FIG. 3, it appears these cracks do not cause the dry layer to become electrically discontinuous.

Regardless of the cause, shut down is often advantageous. For example, shut down provides controlled heating for some applications. Also, a substrate which is not capable of withstanding high temperature can be protected from charting or burning. This is true for example, where moderate heating performance is desired such as when a paper substrate is used. In fact, the coating material of the present invention can be formulated to shut down at temperatures very close to the point which a paper or other substrate would char in a no load situation.

On the other hand, shut down is undesirable in some applications; specifically, when high heating performance is required in the particular application. Above these temperatures foods requiring high temperatures can be effectively cooked or baked such that a relatively traditional appearance and texture is achieved. Examples of foods requiring such temperatures include foods with high moisture content such as baked goods; i.e., cupcakes, muffins and brownies.

Shut down due to volumetric expansion of the silicate binder can be reduced by adding a saccharide to the coating material mixture. Exemplary saccharides include high fructose corn syrup, high maltose corn syrup, sucrose, dextrose. Although not technically a saccharide, sorbitol can also be included in this list. A weight ratio of silicate solids:saccharide of about 40:60 or less (i.e., or less saccharide) are preferred. Higher ratios of saccharide result in soft tacky coatings which are usually undesireable. Glycerine is another preferred additive which can reduce the shutoff tendency. A weight ratio of silicate solids:glycerine of about 40:60 or less (i.e., or less glycerine) are preferred. Higher ratios of glycerine result in soft tacky coatings which are usually undesireable.

Although not wishing to be bound by theory, it appears the reason for the increased shut off temperature when glycerine and saccharides are added to the coating material is that these additives decrease the vapor pressure. Thus, the water in the silicate coating boils off at higher temperatures. This results in an observed decrease in expansion of the silicate matrix which does not significantly physically alter the electrical quality of the contact between the active particles. Since only a small change in the resistivity results, the system heats at a constant rate without a significant decrease in heat flux.

Shut down due to the relative rates of expansion between the substrate and the coating material can be minimized in several ways. A substrate can be chosen which has a rate of expansion similar to the relatively brittle dry layer (i.e. glass). A silicate can be chosen which is less brittle when dry. Additives can be added to the mixture which make the silicate less brittle when dry. For example, a plasticizer of some sort may be used. The saccharides and glycerine indicated above are plasticizers make the dry layer less brittle reducing this type of shut down as well.

In addition, plasticizers may be desirable in particular applications where shut down is also desired. For example, a less brittle coating material would be desirable if the substrate needed to be formed into a particular shape after coating. In these instances saccharide or glycerine additives may be used if a balance is struck between the flexibility desired and the maximum temperature desired. Alkaline-stable polymer latex plasticizers are another preferred class of plasticizers. Plasticizers within this class can be purchased from Findley Adhesives, Inc., Wauwatosa, Wis. as No.695-883 ethylene vinyl acetate emulsion, Adhesive No. M2244 vinyl acetate-ethylene copolymer, and Adhesive M2245 vinyl chloride-vinyl acetate-ethylene terpolymer.

The latex plasticizer is slowly added to the silicate/-graphite mixture with vigorous mixing. A sodium silicate:plasticizer weight ratio is preferably about 2:1 or less (i.e., less sodium). In order to avoid diluting the amount of active constituent in the coating material the minimum amount of plasticizer is preferably used. Another method which avoids dilution is to apply the latex plasticizer as separate coating layers as an undercoat and/or an overcoat. Thus, the microwave active coating material can be sandwiched between a layer of plasticizer and the substrate or between two layers of plasticizer.

The following examples illustrate the versatility of the coating material of the present invention.

EXAMPLE 1

Laminate Susceptor Baking Cups

Referring to FIGS. 1 and 2, one beneficial use for microwave susceptors of the present invention is in baking cupcakes or other similar foodstuffs having a high moisture content in the standard household microwave oven. This application is exemplary of a susceptor with moderate heating performance. This may be accomplished through the use of a microwave susceptor baking cup 20. Microwave susceptor baking cups 20 are prepared according to the present invention, and can be used to bake yellow cupcakes. Eight cupcakes are baked in a microwave baking box as described below and illustrated in FIG. 4.

The microwave susceptor baking cups 20 themselves are of a laminate structure. The laminate consists of a layer 29 of the dry layer of the coating material of the present invention sandwiched between two layers of paper 28 and 30. The paper 28 and 30 can be purchased from James River, Neenah, Wis. as 50#(0.0035") Duncote II, one side clay coated paper.

Mix 28674.5 grams of 3.22 sodium silicate solution having 37% solids with 26.5 grams of synthetic graphite. The sodium silicate may be purchased from Power Silicates Inc., Claymont, Del. as F grade solution sodium silicate. The graphite may be purchased from Superior Graphite Company, Chicago, Ill. as #5539 Superior Synthetic Graphite. The components are hand mixed in a small glass jar using a stainless steel spatula. Stirring is continued until all lumps are dispersed and the sample is uniformly mixed. A small amount of water may be added to facilitate mixing for very high concentrations of active material. The weight of the sodium silicate solution (grams) times the percent solids divided by 100 ratioed to the weight of graphite equals the silicate:graphite weight ratio on a dry basis. This calculation based upon the above amounts results in a coating material 29 having an 80:20 silicate/graphite weight ratio (dry basis).

This 80:20 coating material 29 is then applied between the two sheets of paper 28 and 30 to form a laminate. The clay coated side of the paper 28 and 30 is placed next to the coating material 29. The coating 29 is applied using a set of gauge rollers set for a 0.002" application thickness to form the laminate. The surface concentration of the active constituent of the dry coating material 29 is about 17 g/m$^2$. The coating material 29 also serves as the adhesive. This laminate structure is dried ambiently for at least three hours.

To alleviate sticking problems upon baking one side of the laminate is coated with a silicone release coating 31. The constituents of the silicone coating can be purchased from PCL Co., Rock Hill, S.C. The silicone release coating 31 is composed of 40 parts PC-165, 3 parts PC-138 and 157 parts water. The release coating 31 is applied with a RDS #12 Mayer Rod which gives approximately 1.08 mils of wet film. The release coating 31 is first dried ambiently for about at least three hours and then cured at 300° F. for two minutes in a convection turbo oven.

Figure 5:
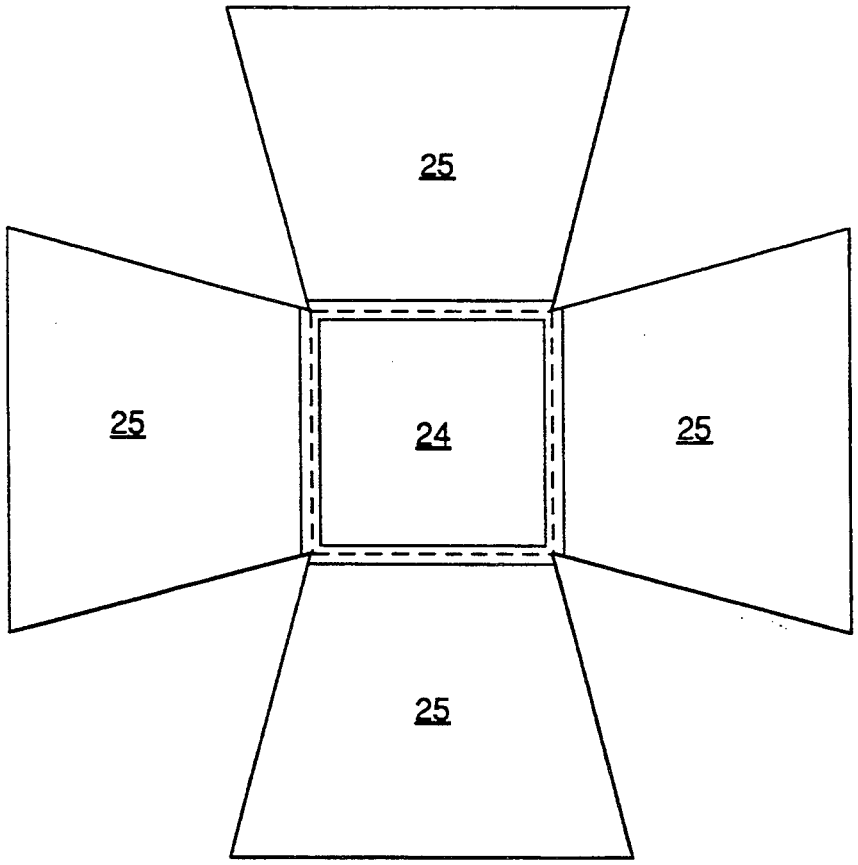
FIG. 5 is a top plan view of a blank used to form the susceptor baking cup of FIG. 1.

Subsequently, the laminate susceptor described above is formed into eight microwave susceptor baking cups 20. Thus, eight microwave susceptor cups 20 are formed measuring about 4.7 cm square at the base, and about 6.0 cm square at the top, and a depth of about 2.9 cm each. The baking cups 20 are formed by cutting out blanks similar to FIG. 5, folding and taping the edges of side panels 25 together with a good scotch tape 26 that will hold during baking.

Figure 4:
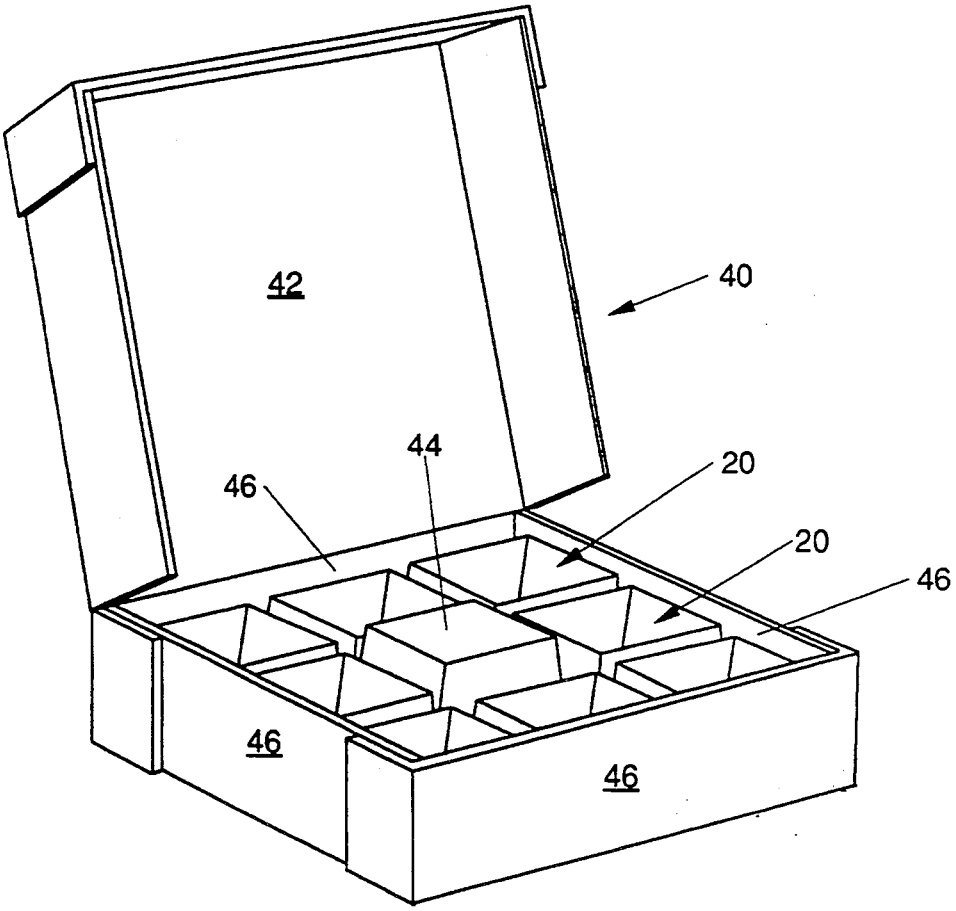
FIG. 4 is a perspective view of a preferred embodiment of FIG. 1 incorporated into a package for cooking cupcakes.

A Duncan Hines® yellow cake batter might be baked in these microwave susceptor baking cups 20. Forty grams of yellow cake batter is placed in each of the eight baking cups 20. Referring to FIG. 4, the eight cups 20 are arranged around the perimeter of an approximately 8"×8"×1⅝" tall card board baking box 40 with a lid 42, leaving the center void. A stack element 44 may be used. The baking box 40 is totally microwave transparent. Alternatively, the baking box 40 may have a microwave shield located on the side walls 46 forming a vertically disposed annular shield and the inside top wall 42 may include a susceptor. The side wall 46 shield and top wall 42 susceptor can be printed patterns of electrically conductive coating materials or commercially available shields and susceptors. The cupcakes are baked four minutes on high power with a rotation of 180° of the box after 1 minute in a 600 watt microwave oven with the baking box 40 and lid 42 closed.

The results of this baking method would be expected to yield good baking results. One critical feature to achieving acceptable cupcakes is moisture loss. Average moisture loss might be about 14%. Furthermore, appearance and texture should be similar to cupcakes baked in conventional thin film baking cups at significant cost savings. Cupcakes baked as described above would exhibit good side rounding, doming & surface appearance.

It would be expected that the laminate structure described above would yield the following test results. The $\Delta T_{120}$ from the Energy Competition Test might be about 154° F. The initial RAT values would indicate all samples were electrically continuous as their values would lie on the RAT electrically continuous curve represented on the three component RAT diagram. Similarly, RAT measurements taken after baking would indicate all samples remained electrically continuous after use. The R-A-T after baking might be about 3.4%–33.3%–63.3%.

EXAMPLE 2

High Heating Performance Baking System

Figure 6:
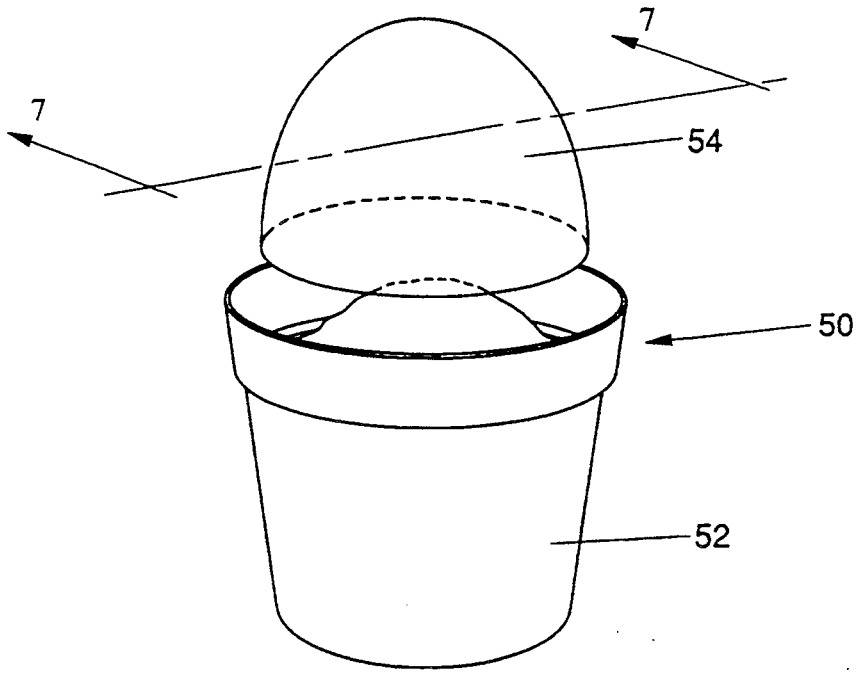
FIG. 6 is a perspective view of another preferred embodiment of a susceptor of the present invention formed into a dome.
Figure 7:
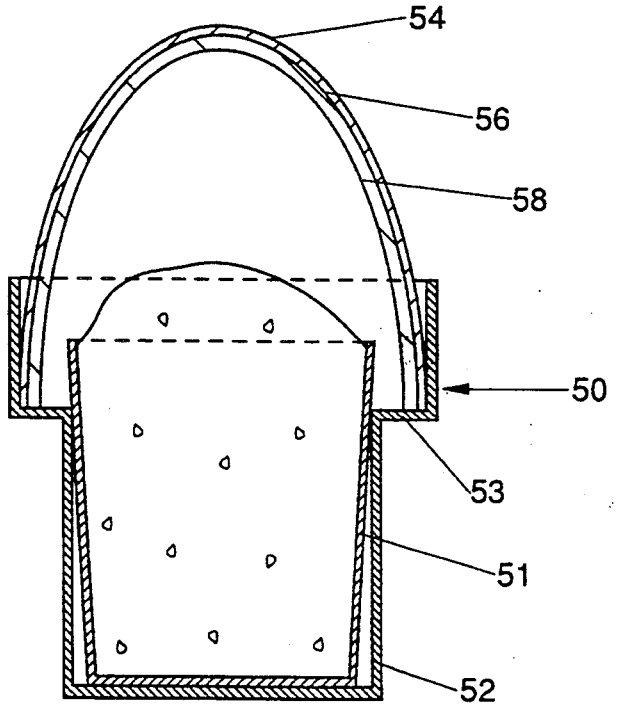
FIG. 7 is a cross-sectional view taken along line 7—7 of FIG. 6.

Referring to FIGS. 6 and 7, another beneficial use of susceptors of this invention is for heating muffins or similar items. This application is exemplary of a high heating performance susceptor. Essentially any standard formulation can be used. For example, a batter prepared from a dry mix such as the Duncan Hines® Blueberry Muffin Mix which has been commercially available can be used. Sixty grams of batter (including blueberries) is placed in a 2" diameter×1¼" commercially available thin film susceptor baking cup 51. The initial height of the batter in the cup 51 is about one inch. Such a thin film baking cup 51 can be purchased from Ivex Inc., Madison, Ga. Alternatively, a baking cup 51 similar to that described in Example 1 above can be used. To illustrate the versatility of this baking system the batter can be frozen in the susceptor baking cups 51 at approximately 0° F. for 24 hours.

The baking system 50 of this Example includes three components. The first component is a pyrex glass base element 52 formed from a 250 ml pyrex beaker, measuring approximately 2¾" diameter×1⅜" high with a 3½" diameter flat lip around its top edge. The second component is the batter filled baking cup 51 which is placed in the base element 52 with a ⅝" glass spacer supporting it. The third component of the microwave baking system i s a pyrex glass dome 54 measuring approximately 3¼" diameter×1¾" high (cut from a 250 ml round bottom boiling flask), which sits on the lip 53 of the base element 52. The outer surface of the dome has a dry layer of a high temperature microwave active coating material of the present invention.

The high temperature coating material 56 is made of sodium silicate, graphite and high fructose corn syrup (HFCS). 17.22 grams of a 3.22 silicate solution having 37% solids is used. A 3.22 sodium silicate may be purchased from Power Silicates Inc., Claymont, Del. as "F" grade solution sodium silicate. 3.31 grams of synthetic graphite is added to the sodium silicate. The synthetic graphite may be purchased from Superior Graphite Co., Chicago, Ill. as #5539 Superior Synthetic Graphite. To the above mixture 4.47 grams of high fructose corn syrup is added. A high fructose corn syrup may be purchased from A. E. Stalley, Decatur, Ill., ISO Sweet 100 at 72% total dissolved solids. This mixture is then hand mixed as discussed in Example 1. Thus, a coating material 56 having a weight ratio based upon dry solids of 49.4% 3.22 sodium silicate; 25.7% synthetic graphite; and 24.9% high fructose corn syrup. Furthermore, the silicate:active weight ratio is about 65.8:34.2 and the silicate:HFCS weight ratio is 66.4:33.6.

This coating material 56 formulation is coated onto the exterior of the dome shaped substrate 58 by hand using a ½" wide brush to provide as uniform of a dry layer 56 as possible. After drying ambiently for at least three hours, its loading of active (graphite) would be from about 22.5 g/m² to about 24.5 g/m². The thickness of the dry coating 56 is in the range of from about 0.001" to about 0.003".

The frozen blueberry muffin batter containing microwave susceptor cup 51 is placed inside the glass base element 52 and the dome 54 is placed over the batter as seen in FIG. 7. This baking system 50 is then baked inside a 615 watt 35 BTU/minute (based on a 1000 gram water load) microwave oven for 2 minutes on high power.

The batter might have about a 12% moisture loss and rise to about 2.0" in height. Furthermore, the muffin would be expected to have a nicely browned top surface and good flavor, moistness and texture.

It would be expected that the dome 54 coated with the coating material 56 would provide the following test results. A $\Delta T_{120}$ of 375° F. as measured by the Energy Competition test. A R-A-T reading of 38%–49%–13% which indicates electrically continuous both initially and after use indicating that the coating material is and remains electrically continuous and did not degrade.

EXAMPLE 3

Microwave Frying of Pork Sausage

Figure 8:
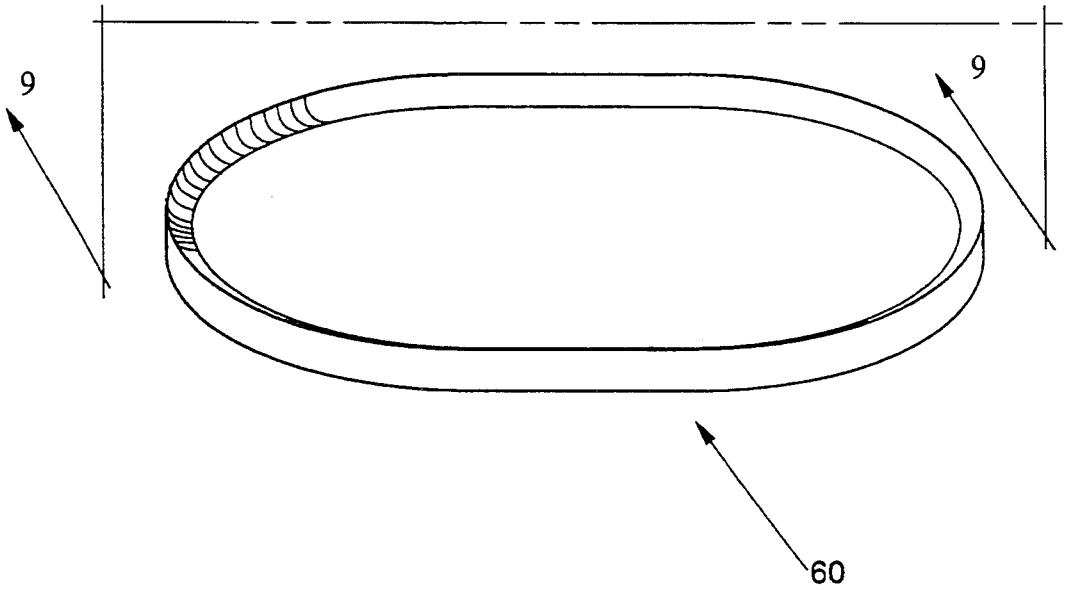
FIG. 8 is a perspective view of an additional preferred embodiment of a microwave susceptor of the present invention which can be used for frying.
Figure 9:
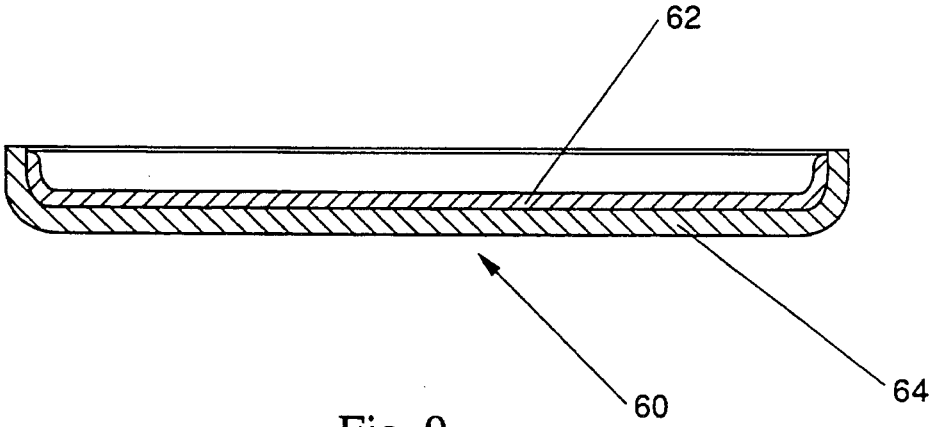
FIG. 9 is a cross-sectional view taken along line 9—9 of FIG. 8.

Referring to FIGS. 8 and 9, two fresh sausage links are fried using a simulated glass frying pan 60 coated with a coating material 62 of the present invention. This application is exemplary of a high heating performance susceptor. The coating material 62 of this Example includes 3.22 sodium silicate and nickel flakes in a 35/65 weight ratio. This coating is created by mixing 19.9 grams of 3.22 sodium silicate solution having 37% solids with 13.6 grams nickel flakes as discussed in Example 1. The 3.22 sodium silicate can be purchased from Power Silicates Inc., Claymont, Del. as F Grade Solution sodium silicate. The nickel may be purchased from Novamet Company, Wyckoff, N.J., as Nickel HCA-1 flakes. This results in a weight ratio of 35:65 of silicate to active.

The simulated frying pan 60 is created by coating the coating material 62 on the inside bottom of a petri dish cover substrate 60 which is approximately 3¾" in diameter. A ½" brush is used to coat the petri dish cover 60 by hand as uniformly as possible. The coating 62 is dried ambiently for over two hours. The dry coating 62 has a thickness in the range of about 0.001" to about 0.003". The surface concentration of the active in the dry layer 62 would be about 291 g/m$^2$.

Two sausage links having an initial weight of about 55 grams are placed in the simulated frying pan 60. Bob Evans Farms® small casing links can be used. The links are cut in half to provide four links which fit side by side in the susceptor frying system 60. In addition, eight grams of Crisco Oil® was placed in the frying system 60. The sausage was heated for 1 minute and 45 seconds in a 615 watt G.E. microwave oven, without preheating the oil or susceptor 60. At one minute fifteen seconds the sausage is turned over to brown the other side for the last thirty seconds.

The sausages are expected to be well browned on both sides and have a weight loss of about 22%. The eating quality would likewise be very good and include a browned flavor. The coated petri dish 60 would be expected to provide the following test results. A $\Delta T_{120}$ of about 248°. The initial R-A-T for the petri dish 60 would be expected to be about 78%-20%-2%.

EXAMPLE 4

Coated Susceptor Baking Cups with Plasticizer

Figure 10:
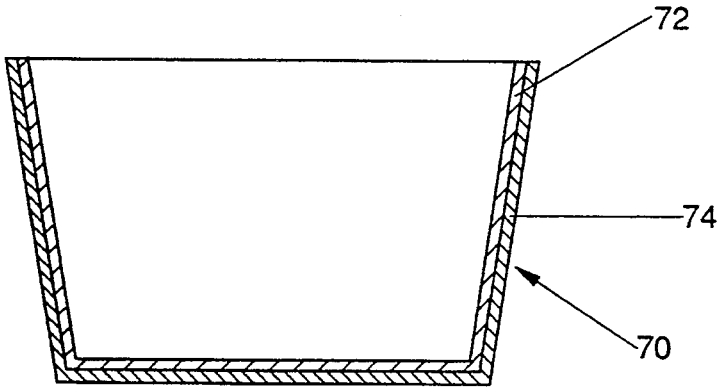
FIG. 10 is an enlarged cross sectional view similar to FIG. 2 of another microwave susceptor baking cup of the present invention.

Referring to FIG. 10, a microwave susceptor coating material 72 for use on microwave baking cups 70 can be prepared which has a significant degree of flexibility. This application is exemplary of a moderate heating performance susceptor. This susceptor coating material 72 contains glycerine as an additive to improve the dry coating's 72 flexibility when dry. The coating material 72 includes 9.64 grams of 3.22 sodium silicate solution having 37% solids; 1.80 grams of synthetic graphite; and 3.56 grams of glycerine. The 3.22 sodium silicate can be purchased from Power Silicates Inc., Claymont, Del. as F Grade Solution sodium silicate. The synthetic graphite can be purchased from Superior Graphite Co., Chicago, Ill. as Synthetic Purified Graphite No. 5539. The glycerine may be purchased as Lab Grade Glycerine from Fisher Scientific, Fairlawn, N.J. Upon mixing these ingredients an 80:20 weight ratio of silicate to active results. The glycerine to silicate ratio is a 50:50 weight ratio.

Two coats of this coating material 72 is hand painted onto the coated side of a clay coated paper substrate 74 with a ½" brush. The paper 74 is 3 mil. paper and can be purchased from James River, Neehah, Wis. as 50#(0.0035") Dun-cote II one side clay coated paper. The coating 72 is ambiently dried for at least two hours. The dry layer 72 might have a coating thickness of about 0.004" and a surface concentration of the active of about 20 g/m$^2$ to about 35 g/m$^2$.

The microwave susceptor created above is formed into baking cups 70 as described in Example 1. The susceptor coating material 72 side is placed next to the batter. During this forming process less cracking and flaking of the coating material 72 is expected. This dry layer 72 is more flexible than a similar coating without glycerine. The dry layer 72 is expected to remain flexible even after use.

The baking cups 70 are used as described in Example 1 and the baking cups 70 are expected to perform comparably to those of Example 1. However, more sticking may result although this can be alleviated by the addition of a release coating.

The following test results are expected. A $\Delta T_{120}$ in the Energy Competition Test of 198° F., which would provide the necessary power to properly bake the yellow cup cakes. Initial R-A-T values of about 5%-32%-63% changing to about 2%-22%-76% after baking.

Although particular embodiments of the present invention have been shown and described, modification may be made to the microwave susceptor without departing from the teachings of the present invention. Accordingly, the present invention comprises all embodiments within the scope of the appended claims.

What we claim is:

1. A microwave susceptor comprising:

a) a microwave active coating material including an active constituent dispersed in an alkali metal silicate binder; wherein the weight ratio of silicate to the active constituent is from about 98:2 to about 40:60; and b) a dielectric substrate having a dry layer of the microwave active coating material overlaying at least a portion of the substrate, the dry layer being electrically continuous and having a surface concentration of the active constituent of at least about 1.0 gram per square meter.

2. A microwave susceptor according to claim 1 wherein the silicate binder is selected from the group consisting of sodium silicate, potassium silicate and lithium silicate.

3. A microwave susceptor according to claim 1 wherein the active constituent is selected from the group consisting of metals and semiconductors.

4. A microwave susceptor according to claim 2 wherein the active constituent is selected from the group consisting of carbon or graphite.

5. A microwave susceptor according to claim 1 wherein the microwave active coating material further comprises an additive selected from the group consisting of high fructose corn syrup, high maltose corn syrup, sucrose, dextrose, sorbitol or glycerine.

6. A microwave susceptor according to claim 4 wherein the microwave active coating material further comprises an additive selected from the group consisting of high fructose corn syrup, high maltose corn syrup, sucrose, dextrose, sorbitol or glycerine.

7. A microwave susceptor according to claim 1 wherein the dry layer has a thickness between about 0.0001 inches and about 0.020 inches.

8. A microwave susceptor according to claim 6 wherein the dry layer has a thickness between about 0.0001 inches and about 0.020 inches.

9. A microwave susceptor according to claim 1 wherein the microwave active coating material has a dry moisture content of up to about 25 percent.

10. A microwave susceptor according to claim 8 wherein the microwave active coating material has a dry moisture content of up to about 25 percent.

11. A microwave susceptor according to claim 2 further comprising a cover layer adjacent the dry layer of microwave reactive coating material whereby the dry layer is interposed between the cover layer and the substrate.

12. A microwave susceptor according to claim 10 further comprising a cover layer adjacent the dry layer of microwave reactive coating material whereby the dry layer is interposed between the cover layer and the substrate.

13. A microwave susceptor according to claim 1 wherein the silicate binder is a sodium silicate binder which has a weight ratio of $SiO_2$:$Na_2O$ of 3.22:1.

14. A microwave susceptor comprising:

a) a microwave active coating material including a quantity of graphite as an active constituent dispersed in a quantity of sodium silicate as a binder; wherein the weight ratio of the sodium silicate to the graphite is from 98:2 to about 40:60; and b) a dielectric substrate having a dry layer of the microwave active coating material overlaying at least a portion of the substrate, the dry layer being electrically continuous and having an surface concentration of the active constituent of at least about 1.0 grams per square meter.

15. A microwave susceptor according to claim 14 wherein the microwave active coating material further comprises an additive selected from the group consisting of high fructose corn syrup, high maltose corn syrup, sucrose, sorbitol, dextrose and glycerine.

16. A microwave susceptor according to claim 14 wherein the microwave active coating material further comprises an active selected from the group consisting of metals and semiconductors.

17. A microwave susceptor according to claim 14 further comprising a cover layer adjacent the dry layer of microwave reactive coating material such that the dry layer is interposed between the cover layer and the substrate.

18. A microwave susceptor according to claim 14 wherein the dry layer has a thickness between about 0.0001 inches and about 0.020 inches.

19. A microwave susceptor according to claim 14 wherein the microwave active coating material has a dry moisture content of up to about 25 percent.

20. A microwave susceptor exhibiting moderate heating performance comprising:

(a) a microwave active coating material including an active constituent dispersed in a silicate binder; wherein the weight ratio of the silicate to the active constituent is from about 90:10 to about 80:20; and (b) a dielectric substrate having a dry layer of the microwave active coating material overlaying at least a portion of the substrate for generating the moderate heating performance, the dry layer being electrically continuous and having a surface concentration of the active constituent of at least about 1.0 gram per square meter.

21. A microwave susceptor according to claim 20 wherein the silicate binder is a sodium silicate.

22. A microwave susceptor according to claim 20 wherein the active constituent is selected from the group consisting of carbon or graphite.

23. A microwave susceptor according to claim 20 wherein the substrate is made of a cellulosic material.

24. A microwave susceptor according to claim 21 further comprising a cover layer adjacent the dry layer of microwave reactive coating material whereby the dry layer is interposed between the cover layer and the substrate.

25. A microwave susceptor exhibiting high heating performance comprising:

(a) a microwave active coating material including an active constituent dispersed in a silicate binder; wherein the weight ratio of the silicate to the active constituent is from about 80:20 to about 40:60; and (b) a dielectric substrate having a dry layer of microwave active coating material overlaying at least a portion of the substrate for generating said high heating performance; the dry layer being electrically continuous and having a surface concentration of the active constituent of at least about 1.0 grams per square meter.

26. A microwave susceptor according to claim 25 wherein the silicate binder is a sodium silicate.

27. A microwave susceptor according to claim 25 wherein the active constituent is selected from the group consisting of carbon or graphite.

28. A microwave susceptor according to claim 25 wherein the substrate is made of a ceramic material.

* * * * *